United States Patent [19]

Biro

[11] Patent Number: 4,624,091

[45] Date of Patent: Nov. 25, 1986

[54] THERMALLY INSULATED WINDOW SASH CONSTRUCTION

[75] Inventor: Alexander J. Biro, Export, Pa.

[73] Assignee: Winchester Industries, Inc., Saltsburg, Pa.

[21] Appl. No.: 632,910

[22] Filed: Jul. 20, 1984

[51] Int. Cl.[4] ..... E04C 2/38

[52] U.S. Cl. ..... 52/656; 52/730; 52/204; 52/731

[58] Field of Search ..... 52/204, 398, 455, 656, 52/730, 731, 788, 790, 475, 731

[56] References Cited

U.S. PATENT DOCUMENTS

| | | | |
|---|---|---|---|
| 3,289,377 | 12/1966 | Hetman | 52/656 |
| 3,938,291 | 2/1976 | Criswell | 52/731 |
| 4,090,799 | 5/1978 | Crotti et al. | 52/656 X |
| 4,275,526 | 6/1981 | Abramson | 52/731 X |
| 4,407,105 | 10/1983 | Frank | 52/656 X |
| 4,420,919 | 12/1983 | Weber | 52/204 |

FOREIGN PATENT DOCUMENTS

| | | | |
|---|---|---|---|
| 2719490 | 11/1978 | Fed. Rep. of Germany | 52/730 |
| 2359956 | 7/1976 | France | 52/204 |

*Primary Examiner*—William F. Pate, III
*Assistant Examiner*—Creighton Smith
*Attorney, Agent, or Firm*—Parmelee, Miller, Welsh & Kratz

[57] ABSTRACT

A window sash member is composed of a pair of rail members and a pair of vertical sash members or stiles which may each include a framing element having a unique cross-sectional configuration. The sash member is so constructed as to permit replacement of glass panes without destroying the integrity of the frame. This is accomplished by removing a series of glazing strips. A hollow defined within the framing element provides the rails with a reinforcing member which has fins to minimize undesired thermal conduction across the frame. A downwardly open recess is defined within the framing element so as to permit it to be employed with a wide variety of window frame elements and adapting it for use in a wide variety of types of windows. The rails are preferably joined to the stiles by welding. The sash framing element is particularly adapted to be used with insulated windows having two or three panes of glass which define a thermally insulating dead air space therebetween. The sash framing elements are preferably composed of a synthetic resinous material.

27 Claims, 16 Drawing Figures

THERMALLY INSULATED WINDOW SASH CONSTRUCTION

BACKGROUND OF THE INVENTION

1. Field Of The Invention

The present invention relates to improved thermally insulated window sash constructions and a uniquely configurated framing element for use therein.

2. Description Of The Prior Art

Numerous types of window constructions have been used previously in an effort to resist undesired heat loss from a building or undesired heat gain into a building. It has been known to place "storm windows" on the exterior of regular windows to minimize air leakage, conduction of heat and undesired condensation on the window interior during cold weather.

It has also been known to employ windows having two or more panes of glass with a dead air space therebetween. In connection with such windows which have been evacuated and sealed, problems have been encountered with air leakage and undesired condensation of moisture between the two panes of glass. Also, it has been known to employ metal frames such as aluminum frames for such windows. As aluminum is a good conductor of heat, condensation on the frames has resulted. Also, the aluminum surface could oxidize, scratch, pit or dent. It has also been known to provide thermal breaks in such frames to minimize thermal conduction through the sash frame.

It has also been known to employ vinyl sash frames in an effort to minimize heat conduction through insulated replacement window sash frames.

While a number of the above-described advances in the art have served to improve the efficiency through reductions in undesired heat transfer through conduction or leakage as well as condensation, there remains a very real and substanial need for further improvements in thermally insulated windows.

SUMMARY OF THE INVENTION

The present invention has met the above-described need. A window sash frame may have horizontal rails and vertical members or stiles employing a framing element of the identical cross-section. Rails may have a hollow chamber for insertion of reinforcing means. The sash frame may be established by thermally welded jointure, as by a miter joint of the rails to the stiles. The glazing strip may be secured to each framing element so as to permit replacement of glass without requiring full disassembly or destruction of the sash frame. The lower extremity of the framing element for the sash may be so configurated as to be adapted to be used in combination with a wide variety of types of windows such as a double hung, sliding, single hung and pivoting ventilator type windows, for example.

The rail assembly may be such as to permit effective mechanical securement of handle elements and latch and keeper elements with anchorage being effected in metal reinforcing members.

It is an object of the present invention to provide a window sash member which is adapted to permit integral reinforcing means to be incorporated within rail members.

It is another object of the present invention to provide such a window sash member wherein a uniquely configurated sash framing element may be employed in both rails and vertical members.

It is a further object of the present invention to minimize tolerance problems and leakage through joints between vertical members and rails by providing a thermally effected welded joint for such connections.

It is a further object of the present invention to provide such a window construction which is adapted to be made of a material having a low thermal conductivity.

It is a further object of the present invention to provide such a sash construction wherein glass replacement may be effected readily by removing the glazing strips.

It is a further object of the present invention to provide such a sash framing element which is adapted to cooperate with a wide variety of types of window frames.

It is a further object of the present invention to provide such a window sash construction wherein effective means for resisting undesired conduction of heat through the window and seepage of air and moisture condensation through the window are all accomplished in an economical and aesthetically pleasing fashion.

These and other objects of the invention will be more fully understood from the following description of the invention on reference to the illustrations appended hereto.

DESCRIPTION OF THE PREFERRED EMBODIMENT

Figures 1, 2:
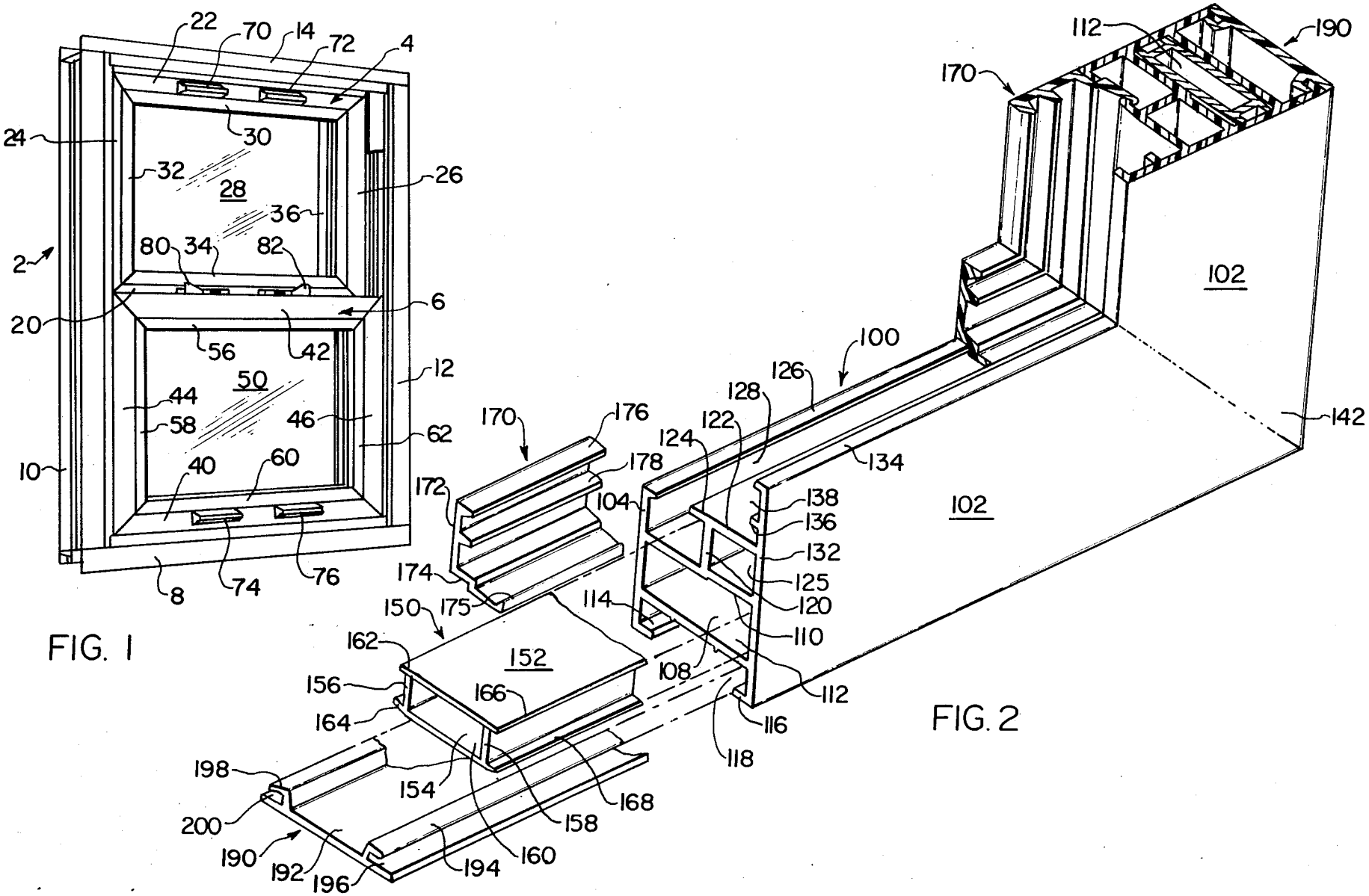
FIG. 1 is a perspective view of a form of double hung window employing sash members of the present invention.
FIG. 2 is a partially exploded, fragmentary perspective view showing a portion of a joint between a sash rail member and sash vertical member of the present invention.

Referring more specifically to FIG. 1, there is shown a window 2 which, in the form shown, is a double hung window having an upper sash 4 and a lower sash 6. As the window sill 8 jambs 10, 12 and head 14 do not form part of the invention per se, they may take any form which is structurally compatible with the unique window sash member of the present invention.

The upper sash 4 has a bottom rail 20, a top rail 22 and vertical members or stiles 24, 26. A glass pane 28 is retained in place by glazing strips 30, 32, 34, 36. Similarly, bottom sash 6 has a bottom rail 40, a top rail 42 and vertical members or stiles 44, 46. Glass pane 50 is retained in position by glazing strips 56, 58, 60, 62. Handles 70, 72 are secured to the upper rail 22 of upper sash 4 and handles 74 76 are secured to lower rail 40 of the bottom sash 6. Rotating latch members 80, 82 are secured to upper rail 42 and cooperate with associated keepers (not shown) in lower rail 20 of upper sash 4 to provide a locked position wherein relative movement between the sash members 4, 6 is prohibited.

One of the principal elements of the present invention is the uniquely configurated sash framing element and the associated components which combine to create the rail or vertical member construction. These features will be discussed in detail with reference to FIG. 2 and other associated figures.

Figure 4:
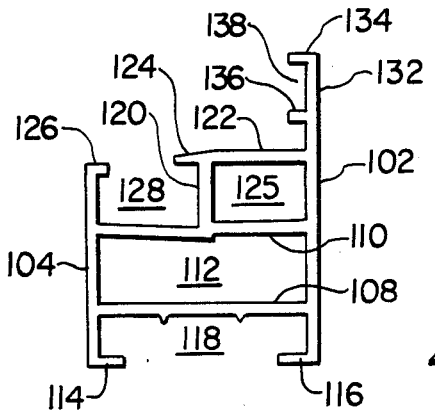
FIG. 4 is an end elevational view of the framing element of FIG. 3.
Figure 3:
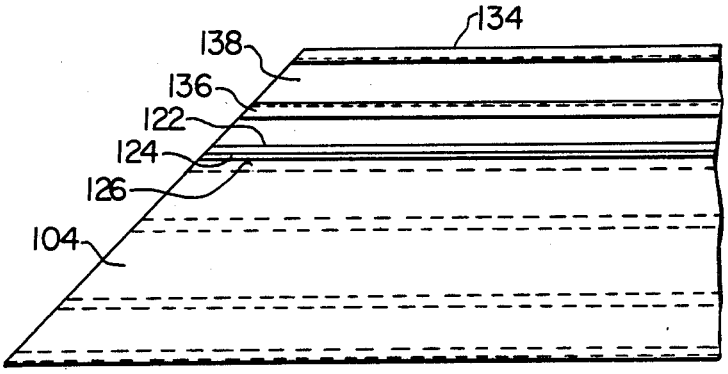
FIG. 3 is a front elevational view of a portion of a sash framing element of the present invention.
Figure 5:
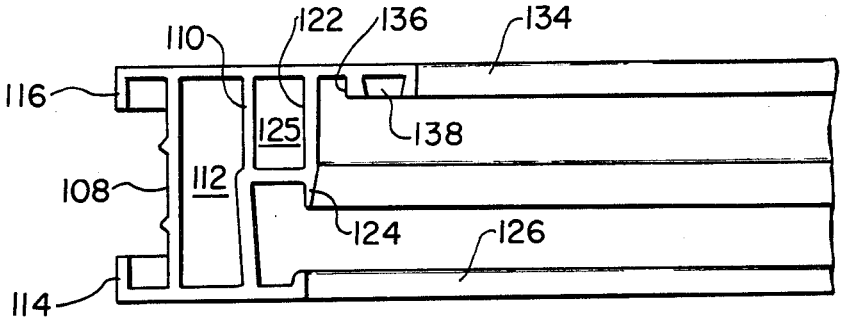
FIG. 5 is a top plan view of the framing element of FIG. 3.
Figure 7:
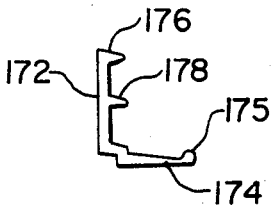
FIG. 7 is a left-hand elevational view of the glazing strip of FIG. 6.

Before getting into the structural details, a standard of orientational reference will be defined in order to facilitate clarity of disclosure. It will be appreciated that the sash framing element 100, as shown in FIGS. 2 and 4, will be in various positions with respect to the sash frame depending upon whether it is in the position of lower rail, upper rail or either vertical member. For convenience of description, with reference to the structure shown in FIGS. 2 and 4, a direction moving vertically through the structure toward the upper end of the drawing page will be considered upwardly, the reverse direction will be considered downwardly and a direction perpendicular to the upward and downward directions will be referred to as transverse. A direction moving from either outer extremity transversely toward the interior of the shape will be considered transversely inwardly.

Referring in greater detail to FIGS. 2–5, details of the sash framing element 100 will be considered. The sash framing element 100 is shown in the position of the lower rail. It has a first sidewall 102 and a second sidewall 104 which is disposed generally parallel with respect to the first sidewall 102. The first sidewall 102 has a greater vertical extent than the second sidewall 104. A first transverse wall 108 connects the sidewalls 102, 104 as does a second transverse wall 110. The first and second transverse walls 108, 110 cooperate with portions of the first sidewall 102 and second sidewall 104 to define a first elongated hollow chamber 112 which, in the form shown, is substantially rectangular.

First sidewall 102 terminates in a transversely inwardly directed flange 116 and second sidewall 104 terminates in a transversely inwardly directed flange 114. These portions of the sidewalls cooperate with first transverse wall 108 to define a generally downwardly open recess 118.

Interior wall 120 has its lower end connected to second transverse wall 110 and its upper end connected to third transverse wall 122, thus defining a second hollow chamber 125. Third transverse wall 122 projects from first sidewall 102 and beyond transverse wall 122 in the form of extension 124. Generally transversely inwardly directed flange 126 on second sidewall 104 cooperates with portions of second transverse wall 110, third transverse wall 122 and extension 124 thereof to define a generally upwardly open recess 128.

The portion of first sidewall 102 which projects upwardly beyond third transverse wall 122 has been designated 132 and has a pair of inwardly projecting ribs 134, 136 which serve to define a gasket retaining recess 138.

As is shown in FIG. 2, vertical framing member 140 has substantially the identical cross-sectional configuration as rail framing element 100. These elements are shown as being joined at a miter joint 142 which in the preferred practice of the present invention is effected by welding. One of the shortcomings of prior systems involved difficulty in achieving the desired joint due to components which might be slightly out of tolerance in respect of dimension or shape and the further problem that miter joints have been known to leave gaps through which undesired air infiltration can occur. In the present system, the rail member 100 and vertical member 140 are subjected to local elevation of temperature at their free ends and under the influence of pressure, while subjected to the elevated temperature, are caused to self bond through welding action thereby creating the precise desired leak-free joint. As a result of the manner in which the glass panes are retained in the sash of the present invention, it is possible and preferred to effect all four joints between the rails and vertical members through this welding action.

It will be appreciated that the rail framing element 100, except for the joint area, preferably has a substantially uniform cross-sectional configuration throughout its longitudinal extent. If desired, weep holes may be provided in portions of first transverse wall 108 and second transverse wall 110 in order to permit any moisture entering recess 128 to drain downwardly and out of the structure through recess 118. Such local weep hole discontinuities shall not be deemed for purposes of the present disclosure to depart from the cross-sectional configuration being "substantially" uniform throughout the longitudinal extent of the rail member. Similarly, the stile member 140 has a framing element which preferably has a substantially uniform cross-sectional configuration throughout its longitudinal extent. In the preferred embodiment of the invention, the cross-sectional configuration of the rail members and vertical or stile members are substantially identical. This serves to facilitate use of a single extrustion die in manufacturing the component and permits a single profile to be used for both purposes.

Referring still to FIG. 2, there is shown a preferred form of reinforcing member 150. In a preferred practice of the invention, the rail and vertical framing members will be formed by extrusion and be composed of a resinous plastic material such as vinyl, for example. While these resinous plastic materials are preferably substantially rigid, in order to further strengthen the structure, it is preferred that reinforcing member such as that identified by the reference number 150 be provided substantially coextensively with the rail members, but not within the vertical members, although they could be employed in both types of elements should such usage be desired. In the form illustrated, the reinforcing member is a hollow, generally rectangularly configurated element having its major axis in a transverse direction.

Generally parallel walls 152, 154 are separated by walls 156, 158. The reinforcing member may preferably be metal such as an aluminum extrusion, for example. A preferred feature of this form of reinforcing member is that it substantially completely fill the peripheral portions of recess 112. It will be noted that fin elements 162, 164, 166, 168 project transversely from the reinforcing member. This serves to reduce the amount of metal which comes into contact with sidewalls 102, 104 within recess 112 thereby minimizing the likelihood of the reinforcing member permitting meaningful conductive heat transfer through the sash framing member.

Figure 6:
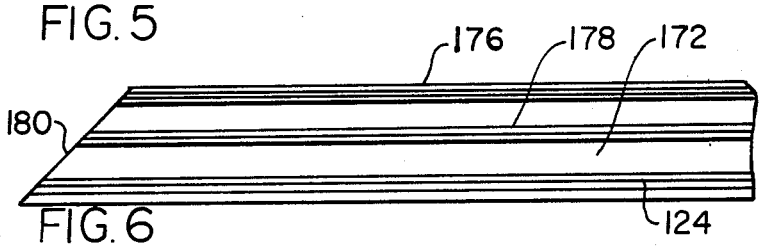
FIG. 6 is a front elevational view of a portion of a glazing strip of the present invention.
Figure 8:
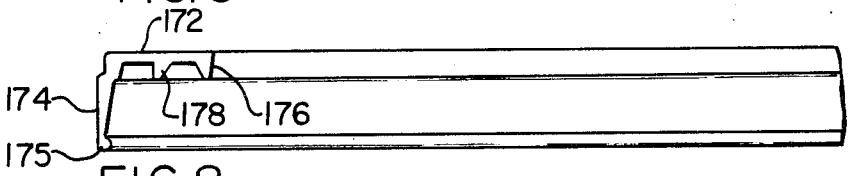
FIG. 8 is a top plan view of the glazing strip of FIG. 6.
Figure 10:
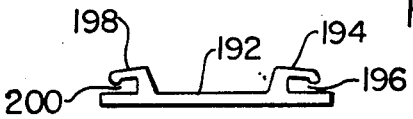
FIG. 10 is an end elevational view of the cap member of FIG. 9.
Figure 9:
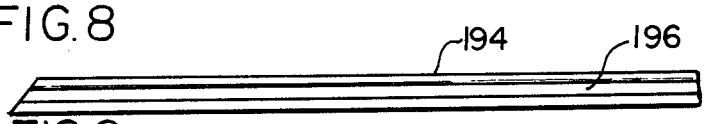
FIG. 9 is a front elevational view of a cap member employable in the present invention.
Figure 11:
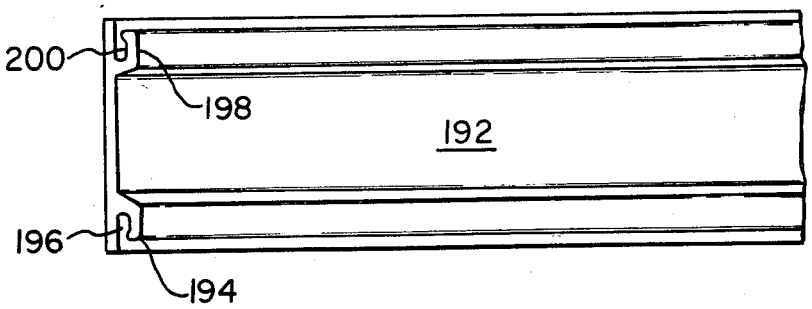
FIG. 11 is a top plan view of the cap member of FIG. 9.

Referring to FIGS. 1, 2 and 6 through 8, a preferred form of glazing strip will be considered. It is this glazing strip in combination with the uniquely configurated sash framing member which permits glass to be replaced in the sash without requiring destruction of the miter joint created frame. The glazing strip 170 is generally L-shaped and has a first leg 172 and a second leg 174. Leg 174 terminates in an enlargement 175 which is intended to be engaged under third transverse wall extension 124. A pair of transversely inwardly directed ribs 176, 178 project from leg 172 and are adapted to be in engagement with one surface of one of the glass panes. Another feature of this "drop in" glazing which is best shown in FIGS. 1 and 6 is the biased edge 180 which mates with a similar edge of the adjacent glazing strip. This creates a mitered appearance. It is preferred that this miter line be generally aligned with miter joint 142 of the frame (FIG. 2).

Referring to FIGS. 2 and 9 through 11, the form of cap member which is adapted to be used with the sash rails is shown The cap member 190 has a main web 192 and a pair of transversely outwardly projecting flanges 194, 198 which respectively define recesses 196 and 200 which in turn receive flanges 116, 114. This permits the cap to be inserted through relative longitudinal sliding movement between the sash frame member and the cap thereby closing recess 118. If desired, weep holes (not shown) may be provided in web 192.

In the event the sash frame is employed with other types of windows, different attachments may be secured to this portion of the sash framing members. Roller inserts, for example, could be secured within recess 118.

It will be appreciated that the sash framing assembly is preferably composed substantially completely of a synthetic resinous material with the exception of the reinforcing member 150. This serves to provide the desired thermal insulation while establishing other desired performance characteristics. This material serves to eliminate the need for undesired painting, resists chipping, scratching and other aesthetically unpleasing changes in the article.

Figure 12:
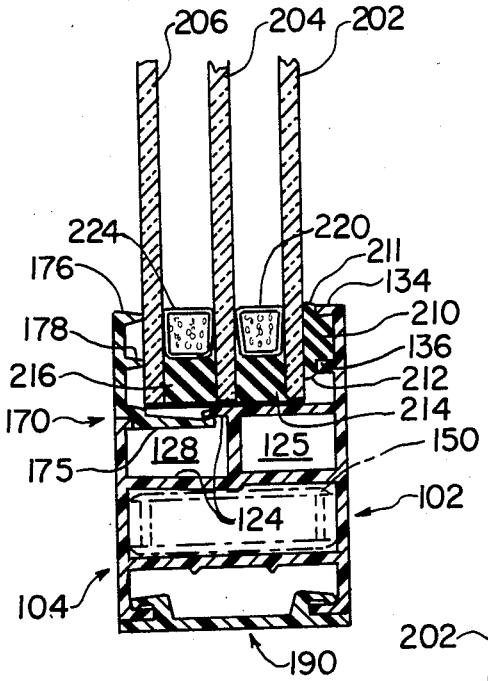
FIG. 12 is a cross-sectional view of a portion of the sash member of the present invention.

Referring to FIG. 12, there is shown a cross-sectional illustration of a sash frame of the present invention. The sash in this embodiment has three panes of glass 202, 204, 206 which are disposed in generally parallel spaced relationship. Pane 202 is supported adjacent its periphery on one surface by gasket 210 which is secured in the recess defined within sidewall 102. In the preferred form as shown, the gasket 210 has a generally T-shaped configuration with shoulders 211, 212 interposed between glass pane 202 and ribs 134, 136 of leg 102 to resist contact therebetween. Among the preferred materials for gasket 210 is ethylene propylene diene methane which is offered under the trade designation EPDM by Lauren Manufacturing Company, of New Shiloh, Ohio. Pane 206 has contact along its periphery with transversely inwardly projecting ribs 176, 178 of glazing strip 170. It is noted that the glazing strip as a result of the undercut in the lower leg 174 (FIG. 7), is received on flange 126 (FIG. 4) of sidewall 104 and has its enlarged portion 175 underlying projection 124 of third transverse wall 122.

Interposed between glass panes 202 and 204 are gasket member 214 and overlying spacer 220 which may take the form of a tubular aluminum extrusion. Similarly, panes 204, 206 are provided with a gasket 216 and an overlying spacer 224. In the form shown, the spacer 224 has been filled with a suitable dessicant in order to absorb any moisture which might be contained within the air trapped between the panes 204, 206.

Referring to FIGS. 2 and 12, should it be desired to replace the glass in the window, all that is required is that the glazing strips 170 be removed. This permits free withdrawal of the glass pane assembly in a direction toward the left as shown in FIG. 12. The replacement glass may then be inserted and the glazing strips 170 replaced. In general, it will be preferred that the three panes of glass be pre-assembled and that their edges be sealed throughout thereby creating a unitary assembly.

Figure 13:
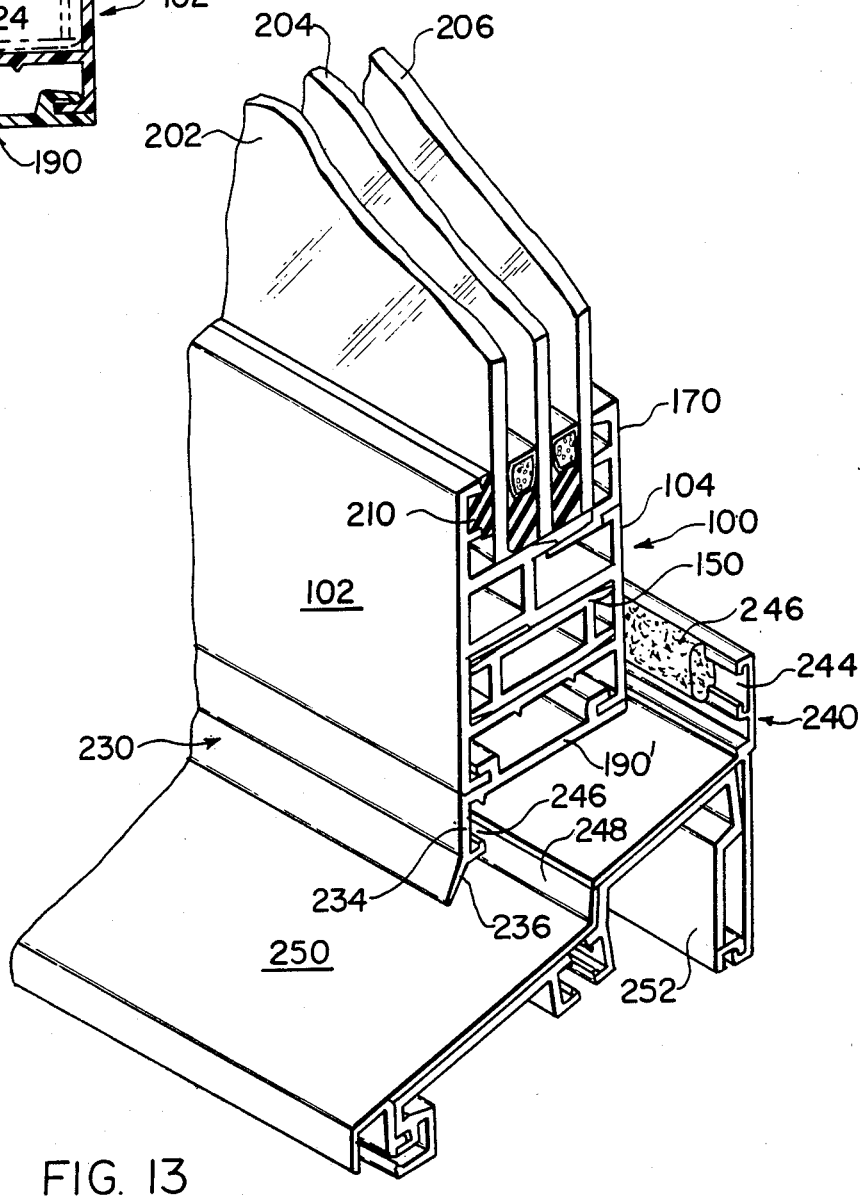
FIG. 13 is a fragmentary perspective view of a portion of the window sash and a portion of the window sill.

Referring to FIG. 13, there is shown sash framing member 100 positioned in overlying supported relationship with respect to a window frame member 240. In this embodiment the modified cap member 190' has a generally downwardly projecting seal 230 which has an upper portion 234 and depending resilient tapered portions 236. Window frame portion 240 has inwardly open channel 244 which supports a gasket 246 which is in contact with leg 104 to effect a seal. Seal 230 has a rearwardly open channel 242 which is adapted to receive a gasket (not shown) for sealing engagement with stepped surface 248 of window frame portion 240. In the form illustrated the window frame portion 240 has a stepped upper member 250 which is in interlocked supported relationship with respect to extrusion 252. In this manner the window sash when in closed position is in sealing contact with respect to the window frame. It will be appreciated that window frames of various slopes may be employed with the sash of the present invention.

Figure 14:
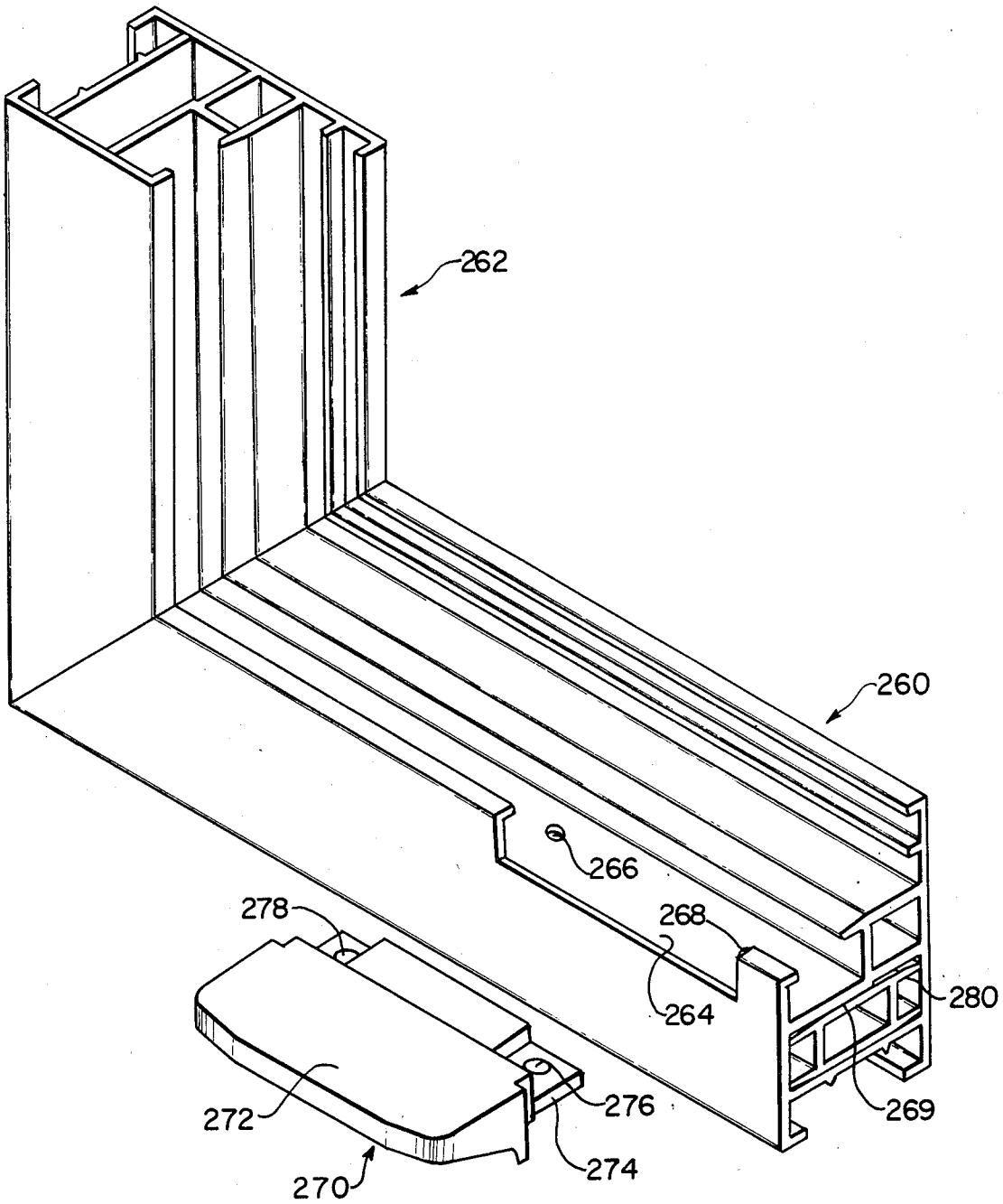
FIG. 14 is an exploded view of a portion of the window sash showing the handle.
Figure 15:
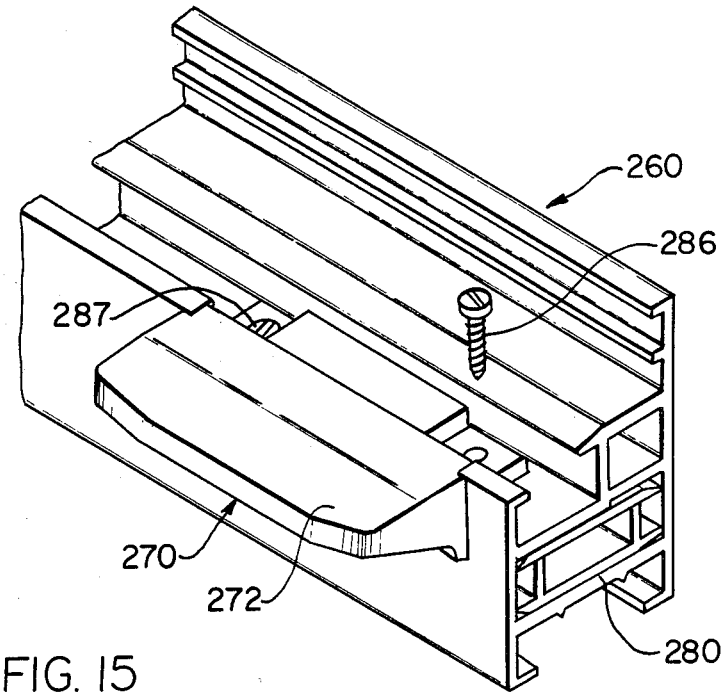
FIG. 15 is a fragmentary perspective view showing a portion of a sash framing element with the handle attached.

As is shown in FIGS. 14 and 15 the invention is adapted to provide firm securement of the window handles to the sash frame. The rail 260 is secured to vertical sash member 262 and has a notch 264. Fastener receiving holes 266, 268 are formed in transverse wall 269. Handle 270 has a gripping portion 272 and an anchoring portion 274. Anchoring portion 276, 278 are adapted to receive fasteners such as screws 286, 287 which will be anchored in reinforcing member 280. In this manner the handle will be effectively anchored with the axis of the fasteners being oriented generally in the direction of window sash movement.

Figure 16:
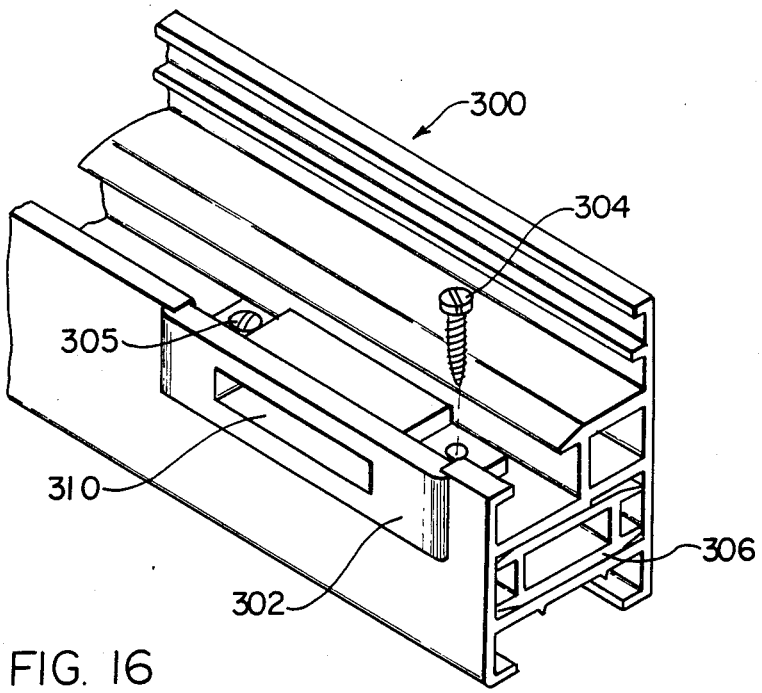
FIG. 16 is a fragmentary perspective view of a sash framing member showing a latch keeper.

In FIG. 16, there is shown a sash framing member 300 which is notched to receive a latch keeper 302 which is anchored by suitable fasteners such as screws 304, 305 to reinforcing member 306. A rotatable latch member secured to another sash in a similar manner (not shown) will be rotated into and out of recess 310.

While for purposes of convenience of illustration herein the preferred system employing three panes of glass has been shown, it will be appreciated that the present invention may also be employed with two panes of glass. For example, with reference to FIG. 12, if pane 204 were to be eliminated, a gasket bridging the gap between panes 202 and 206 and a spacer similarly bridging the gap could be provided.

It will be appreciated, therefore, that the present invention has solved a number of previously unsolved problems in respect of providing a functionally effective, aesthetically pleasing, thermally insulated sash member employing multiple panes of glass. In a preferred form, a resinous plastic material provides a framing element which may be employed for both rails and vertical members or stiles and is adapted to cooperate with reinforcing members and suitable glazing strips to thereby provide sufficient strength and structural integrity while facilitating ease of glass replacement and through the use of the welded miter joints, elimination of undesired tolerance and leakage problems. All of this is accomplished in a simple and efficient manner.

Whereas particular embodiments of the invention have been described above for purposes of illustration, it will evident to those skilled in the art that numerous variations of the details may be made without departing from the invention as defined in the appended claims.

I claim:

1. A window sash member comprising a pair of rails members, composed of a resinous plastic material, fixedly secured to a pair of stile member, composed of a resinous plastic material, to define a unitary sash frame;

said rail members each having a first longitudinally extending hollow chamber;

reinforcing means composed of a material different from said rail members disposed with said first hollow chamber;

the joints between said rail members and said stile members being mitered welded joints;

said rail member except for the joint area having substantially the same cross-sectional configuration throughout their longitudinal extent;

said rail members and said stile members each having a pair of generally parallel sidewalls, a first said sidewall being of greater height than a second said sidewall;

said rail members having a first transverse wall extending from said first sidewall to said second sidewall;

said rail members having a second transverse wall spaced from and oriented generally parallel with respect to said first transverse wall;

said first and second sidewalls and said first and second transverse walls cooperating to define said first hollow chamber;

a third transverse wall means being oriented generally parallel with respect to said and second transverse wall means;

said third transverse wall means extending from said first sidewall and terminating short of said second sidewall;

said second transverse wall being disposed closer to said third transverse wall than is said first transverse wall;

interior wall means oriented generally parallel to said first sidewall means connected said second and said third transverse wall; and said interior wall means cooperating with said second and third transverse walls and said first sidewall to define a second hollow chamber.

2. The window sash member of claim 1 including said second hollow chamber being of lesser cross-sectional area than said first hollow chamber.

3. The window sash member of claim 2 including said third transverse wall projecting beyond said interior wall toward said second sidewall, and said second sidewall cooperating with said second and third transverse walls and said interior wall means to define a generally upwardly open recess.

4. The window sash member of claim 3 including an upper portion of said second sidewall terminating in a transversely inwardly projecting flange.

5. The window sash member of claim 4 including glazing strip members secured to said rail members and said stile members, said glazing strip members being generally L-shaped, a first leg of said glazing strip members being generally aligned with said second sidewall, and a second leg of said glazing member disposed in engagement with said third transverse wall, whereby said glazing strips will be removably secured to said rail members and said stile members.

6. The window sash member of claim 5 including said first sidewall members having ribs projecting generally transversely inwardly and defining a gasket retaining recess, and said first leg of said glazing strips having spacer ribs projecting generally transversely inwardly therefrom.

7. The window sash member of claim 6 including a first pane of glass secured within said sash member, a second pane of glass secured within said sash member in spaced relationship with respect to said first pane of glass, and first gasket means interposed between said glass panes.

8. The window sash member of claim 7 including second gasket means retained on said first sidewall within said gasket receiving recess and being in contact with said first pane of glass, and said glazing strip spacer ribs being in contact with said second pane of glass, whereby replacement of one or more of said panes of glass may be effected by removing said glazing strips.

9. The window sash member of claim 8 including said panes of glass being a sealed assembly.

10. The window sash member of claim 8 including spacer means interposed between said panes of glass.

11. The window sash member of claim 10 including dessicant means for absorbing moisture disposed within said sealed assembly.

12. The window sash member of claim 10 including said spacer means having a tubular metal member.

13. The window sash member of claim 8 including a third pane of glass interposed between and spaced from said first and second panes of glass, and gasket means interposed between said third pane of glass and said first and second panes of glass.

14. The window sash member of claim 5 including said glazing strips tapering toward the free ends thereof, whereby securement of the glazing strips to said rail members and said stile members will establish the appearance of miter joints between adjacent glazing strips.

15. The window sash member of claim 14 including said miter joints of said rail members and said stile members being generally aligned with the adjacent edges of said glazing strips.

16. The window sash member of claim 8 including said second gasket means being of generally T-shape.

17. The window sash member of claim 16 including portions of said second gasket means interposed between said gasket retaining recess defining means, ribs and said first pane of glass.

18. The window sash member of claim 17 including said second gasket means being composed of ethylene propylene diene methane.

19. The window sash framing element comprising:

a first sidewall;

a second sidewall oriented generally parallel with respect to said first sidewall;

a pair of generally parallel spaced first and second transverse walls connecting said first and second sidewalls;

a first hollow chamber defined by said first and second sidewalls and said first and second transverse walls;

said first sidewall extending further upwardly than said second sidewall;

a third transverse wall projecting from said first sidewall terminating short of said second sidewall;

said second transverse wall being interposed between said first and third transverse walls, an interior wall oriented generally parallel with respect to said first and second sidewalls and connecting said second transverse wall with said third transverse wall; and said first sidewall, said interior wall and said second and third transverse walls cooperating to define a second hollow chamber which overlies a portion of said first hollow chamber.

20. The window sash member of claim 19 including:

glazing strip members secured to said rail members and said stile members;

said glazing strip members being generally L-shaped;

a first leg of said glazing strip members being generally aligned with said second sidewall; and a second leg of said glazing member disposed in engagement with said third transverse wall, whereby said glazing strips will be removably secured to said rail members and said stile members.

21. The window sash member of claim 20 including:

said first sidewall member having ribs projecting generally transversely inwardly and defining a gasket retaining recess; and said first leg of said glazing strips having spacer ribs projecting generally transversely inwardly therefrom.

22. The framing element of claim 19 including said second hollow chamber having a cross-sectional area which is less than said first chamber.

23. The framing element of claim 19 including said first and second sidewalls having lower portions provided with transversely inwardly directed flanges, and said first transverse wall and said first and second sidewalls cooperating to define a generally downwardly open recess.

24. The framing element of claim 23 including said third transverse wall projecting beyond said interior wall, and said second sidewall and said first sidewall and said third transverse wall and said interior wall cooperating to define a generally upwardly open recess.

25. The framing element of claim 24 including said framing element being a unitary extruded shape.

26. The framing element of claim 25 including said framing element being composed of a synthetic resinous material.

27. The framing element of claim 24 including an upper portion of said first sidewall having generally transversely generally inwardly projecting ribs defining a gasket receiving recess.

* * * * *